US007482900B2

(12) United States Patent
Hashimoto et al.

(10) Patent No.: US 7,482,900 B2
(45) **Date of Patent: *Jan. 27, 2009**

(54) MICRO RELAY

(75) Inventors: Takeshi Hashimoto, Nishinomiya (JP); Noriteru Furumoto, Hirakata (JP); Naoki Okumura, Osaka (JP); Hideki Enomoto, Ikoma (JP); Takeshi Sadamori, Matsusaka (JP); Shinichi Kishimoto, Sakai (JP); Tsutomu Shimomura, Toyonaka (JP); Kouji Sakai, Takarazuka (JP); Masami Hori, Hirakata (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 253 days.

This patent is subject to a terminal disclaimer.

(21) Appl. No.: 10/556,349

(22) PCT Filed: Jan. 25, 2005

(86) PCT No.: PCT/JP2005/000909

§ 371 (c)(1),
(2), (4) Date: Nov. 10, 2005

(87) PCT Pub. No.: WO2005/071707

PCT Pub. Date: Aug. 4, 2005

(65) Prior Publication Data

US 2006/0250201 A1 Nov. 9, 2006

(30) Foreign Application Priority Data

Jan. 27, 2004 (JP) ..... 2004-018955
Jan. 27, 2004 (JP) ..... 2004-018957

(51) Int. Cl.
*H01H 67/02* (2006.01)

(52) U.S. Cl. ..... 335/128; 335/78

(58) Field of Classification Search ..... 335/78–80, 335/124, 128

See application file for complete search history.

(56) References Cited

U.S. PATENT DOCUMENTS 5,557,132 A * 9/1996 Takahashi ..... 257/415

(Continued)

FOREIGN PATENT DOCUMENTS

EP 1 441 375 A1 7/2004

(Continued)

OTHER PUBLICATIONS

Examination Report dated Jun. 12, 2007 for Japanese Application No. 2004-018955.

(Continued)

*Primary Examiner*—Elvin G Enad
*Assistant Examiner*—Bernard Rojas
(74) *Attorney, Agent, or Firm*—Edwards Angell Palmer & Dodge LLP

(57) ABSTRACT

The micro relay of the present invention comprises a base substrate 3, an armature block 5, and a cover 7. The base substrate 3 has a storage recess 41 for accommodating an electromagnetic device 1. The storage recess is composed of a hole 41*a* penetrating the base substrate 3 and a thin storage recess lid fixed on the one surface of the base substrate to close the hole. The electromagnetic device 1 is isolated from a contact mechanism by the storage recess lid 41*b* to increase the reliability of the contacts. The electromagnetic device 1 includes a yoke 10, a coil 11 wound around the yoke to generate a flux in response to an exciting current, and a permanent magnet 12 secured to the yoke to generate a flux flowing through an armature 51 and the yoke 10. Because the permanent magnet 12 is secured to the yoke 10, this micro relay can reduce the thickness.

22 Claims, 11 Drawing Sheets

U.S. PATENT DOCUMENTS

| | | | | |
|---|---|---|---|---|
| 5,606,447 | A * | 2/1997 | Asada et al. | 359/199 |
| 5,673,785 | A | 10/1997 | Schlaak et al. | |
| 5,872,496 | A * | 2/1999 | Asada et al. | 335/78 |
| 2002/0140533 | A1 | 10/2002 | Miyazaki et al. | |
| 2002/0163408 | A1 | 11/2002 | Fujii et al. | |

FOREIGN PATENT DOCUMENTS

| | | |
|---|---|---|
| JP | 52-107563 | 9/1977 |
| JP | S63-175450 | 7/1988 |
| JP | 04-263508 | 9/1992 |
| JP | 5-21295 | 3/1993 |
| JP | 05-114347 | 5/1993 |
| JP | 5-114347 | 5/1993 |
| JP | 5-342965 | 12/1993 |
| JP | 6-162900 | 6/1994 |
| JP | 6-267392 | 9/1994 |
| JP | H06-251684 | 9/1994 |
| JP | H07-176255 | 7/1995 |
| JP | H07-193160 | 7/1995 |
| JP | H07-211214 | 8/1995 |
| JP | 8-227646 | 9/1996 |
| JP | H09-288952 | 11/1997 |
| JP | 10-050189 | 2/1998 |
| JP | 10-162713 | 6/1998 |
| JP | H11-232987 | 8/1999 |
| JP | 2000-164104 | 6/2000 |
| JP | 2000-200531 | 7/2000 |
| JP | 2001-013443 | 1/2001 |
| JP | 2001-043786 | 2/2001 |
| JP | 2001-076605 | 3/2001 |
| JP | 2001-76605 | 3/2001 |
| JP | 2001-160626 | 6/2001 |
| WO | WO-01/82323 | 11/2001 |
| WO | WO 2004/017349 A1 | 2/2004 |

OTHER PUBLICATIONS

Examination Report dated Jun. 12, 2007 for Japanese Application No. 2004-018957.
Examination Report dated Sep. 4, 2007, for Japanese Application No. 2004-018955. (With Brief English Translation).
Examination Report dated Sep. 4, 2007, for Japanese Application No. 2004-018956. (With Brief English Translation).
Examination Report dated Sep. 4, 2007, for Japanese Application No. 2004-018990. (With Brief English Translation).
Examination Report dated Sep. 4, 2007, for Japanese Application No. 2004-018991. (With Brief English Translation).
Examination Report dated Sep. 4, 2007, for Japanese Application No. 2004-018992. (With Brief English Translation).
Examination Report dated Sep. 4, 2007, for Japanese Application No. 2004-018960. (With Brief English Translation).
Examination Report dated Sep. 4, 2007, for Japanese Application No. 2004-018963. (With Brief English Translation).
Examination Report dated Sep. 4, 2007, for Japanese Application No. 2004-018968. (With Brief English Translation).
Examination Report dated Sep. 4, 2007, for Japanese Application No. 2004-018969. (With Brief English Translation).
Examination Report dated Sep. 4, 2007, for Japanese Application No. 2004-018970. (With Brief English Translation).

* cited by examiner

MICRO RELAY

TECHNICAL FIELD

The present invention relates to a micro relay manufactured by means of semiconductor micromachining technology.

BACKGROUND ART

Japanese Non-examined Patent Publication No. 5-114347 discloses a micro relay manufactured by means of semiconductor micromachining technology. This micro relay is an electromagnetic relay which opens or closes contacts using electromagnetic force of an electromagnetic device, and comprises a base substrate having an electromagnetic device, a frame secured to the base substrate through a spacer, and an armature having a permanent magnet and disposed inside the frame. In comparison with an electrostatic relay which opens or closes contacts using Coulomb's force, such electromagnetic relay can have large driving force, so such electromagnetic relay can enhance the reliability of the relay by increasing contact pressure.

However, in the above micro relay, because the permanent magnet is secured to the armature, it is necessary to connect the armature and the base substrate through the comparatively large spacer to create a space between the armature and the base substrate. Therefore, there is a problem that the thickness of the relay is large.

DISCLOSURE OF THE INVENTION

In view of the above problem, the object of the present invention is to provide a micro relay which can reduce the thickness and enhance the reliability.

A micro relay in accordance with the present invention comprises a base substrate, an armature block, and a cover. The base substrate has an electromagnetic device, and has a fixed contact on one surface thereof. The armature block includes a frame secured to the surface of the base substrate, a movable plate disposed inside the frame and supported rotatably by the frame, and a movable contact base supported by the movable plate and having a movable contact. The movable plate cooperates with a magnetic material provided on a surface thereof to define an armature, and is driven by the electromagnetic device to switch on/off a connection between the fixed contact and the movable contact. The cover is bonded to the frame. The cover creates a space surrounded by the frame and closed between the base substrate to accommodate the armature and the fixed contact. The feature of the present invention resides in that the base substrate has a storage recess for accommodating the electromagnetic device, and the storage recess is composed of a hole extending from the one surface of the base substrate to an rear surface thereof and a thin storage recess lid fixed on the one surface of the base substrate to close the hole, and the electromagnetic device includes a yoke, a coil wound around the yoke to generate a flux in response to an exciting current, and a permanent magnet secured to the yoke to generate a flux flowing through the armature and the yoke.

For the micro relay of the present invention, it is not necessary to provide a spacer between the armature and the base substrate because the permanent magnet is secured to the yoke. Therefore, this micro relay can reduce the thickness. Furthermore, because the electromagnetic device, which includes organic material such as a coil, is put in the storage recess and the electromagnetic device is isolated from the contacts by the storage recess lid, the reliability of the contacts can be improved. Furthermore, because the storage recess is composed of the hole and the storage recess lid, the height of the storage recess can be maximized within a limited height of the base substrate, so that a larger electromagnetic device can be used. Still furthermore, a magnetic gap between the electromagnetic device and the armature can be minimized.

Preferably, the yoke comprises a plate-shaped cross-member and a pair of leg pieces upstanding from both ends of the cross-member, and the permanent magnet has a height, and its opposite faces in a height direction are magnetized to opposite poles, and one pole face of the permanent magnet is secured to a longitudinal center of the cross-member between the pair of leg pieces, and the coil is wound around the cross-member on both sides of the permanent magnet, and top end surfaces of the leg pieces are energized to opposite poles in response to the exciting current to the coil. In this case, because the permanent magnet is disposed at the center of the cross-member and the coil is wound on both sides of the permanent magnet, the electromagnetic device can be constructed thinly. Further, the armature can rotate around the permanent magnet, so that impact resistance and vibration resistance can increase.

More preferably, the cross-member has a concave portion in which the permanent magnet is put. By providing the concave portion, the micro relay can be constructed more thinly. Or, a larger permanent magnet can be used within a limited space so as to increase the reliability of the relay. Furthermore, positioning of the permanent magnet can be done easily.

Preferably, the cross-member has convex portions for preventing the coil from dropping. By providing the convex portion, the coil is prevented from moving to the leg piece and dropping from the cross-member in a manufacturing process of the micro relay. More preferably, the convex portions are formed at four corners on an undersurface of the cross-member. In this case, the convex portions can be used as a mark for positioning the electromagnetic device when the electromagnetic device is transported in an assembling process of the micro relay.

Preferably, an exposed surface of the yoke and a surface of the permanent magnet are coated with resin. In this case, the yoke and the permanent magnet are electrically isolated, and they are protected from rust. Furthermore, a winding of the coil is protected from burrs of the edges of the yoke and the permanent magnet.

Preferably, the top end surfaces of the leg pieces and a top end surface of the permanent magnet are polished to remove resin coating, and the top end surfaces of the leg pieces and the top end surface of the permanent magnet are in the same plane. In this case, it is prevented that the magnetic gap between the electromagnetic device and the armature increases.

Preferably, a cross-section area of each of the leg pieces is formed larger than that of the cross-member. In this case, a predetermined cross-section area for magnetic path can be ensured even if the edge of the leg piece is rounded when the yoke is processed. So, a predetermined suction power can be ensured.

As for the material of the base substrate, when the base substrate is made of glass and the storage recess lid is made of silicon, the storage recess lid can be processed thinly by polish or etching. Further, when the storage recess lid is made of a silicon layer which was formed by selectively removing a silicon substrate and an insulating layer from a SOI substrate which comprises the silicon substrate and the thin film silicon layer formed on the insulation layer of the silicon substrate, the storage recess lid can be processed not only thinly but also precisely.

Preferably, the cover is closely bonded to the frame to create a sealed space surrounded by the frame and closed between the base substrate and the cover, and the base substrate has a fixed contact through-hole extending from the one surface of the base substrate to the rear surface thereof, a fixed contact electrode formed on the rear surface of the base substrate, a fixed contact conductive layer formed on an inner surface of the fixed contact through-hole for an electrical connection between the fixed contact and the fixed contact electrode, and a thin film through-hole lid provided on the one surface of the base substrate to close the fixed contact through-hole. In this case, a sealed micro relay can be constructed, so the reliability of the contacts can be improved. Further, it is easy to electrically connect the fixed contact to an external circuit, while keeping the sealed space. Further, because the through-hole lid is in the same plane with the storage recess lid, it is possible to form the through-hole lid and the storage recess lid at the same time. As a substitute for the through-hole lid, the base substrate may have a metal material buried in the through-hole to close the through-hole. In this case, electric resistance between the fixed contact and the fixed contact electrode can be reduced.

Preferably, the base substrate has, on the one surface thereof, a wiring trace connected electrically to the fixed contact and a ground trace connected to ground, and the wiring trace and the ground trace run in parallel in a spaced relation to each other. In this case, it is possible to set characteristic impedance of the wiring trace to a desired value by designing the distance between the wiring trace and the ground trace appropriately.

When the sealed micro relay has the ground trace, it is preferable that the base substrate has a ground through-hole extending from the one surface of the base substrate to the rear surface thereof, a ground electrode formed on the rear surface of the base substrate for earthing, a ground conductive layer formed on an inner surface of the ground through-hole for an electrical connection between the ground electrode and the ground trace, and a ground through-hole closing means for closing the ground through-hole. In this case, it is easy to ground the ground trace while keeping the sealed space.

As for a contact configuration, a DPST (Double-Pole Single-Throw) micro relay having one normally open contact and one normally closed contact can be configured by providing two pairs of the fixed contacts at both ends in a longitudinal direction of the base substrate and providing two movable contacts corresponding to the two pairs of the fixed contacts on the armature. When one pair of the fixed contacts of the two pairs of the fixed contacts is grounded on the basis of this configuration, a SPST (Single-Pole Single-Throw) micro relay having one normally open contact or one normally closed contact can be configured. In this case, if the two movable contacts are connected electrically to each other through a conductive path, high frequency characteristic (isolation characteristic) of the relay can be improved, because the movable contacts are grounded when the other pair of the fixed contacts which is not grounded is opened.

Preferably, the movable plate is supported by the frame through a supporting spring piece having elastic deformability, and the movable contact base is supported by the movable plate through a pressure spring piece, and the frame, the movable plate, the movable contact base, the supporting spring piece, and the pressure spring piece are formed from one semiconductor substrate. In this case, it is possible to miniaturize the armature and the frame easily by means of semiconductor micromachining technology, and moreover, it is possible to increase the life-span of a physical connection parts between the armature and the frame, and so on.

Preferably, the movable plate has, on a surface facing to the base substrate, a supporting protrusion at a longitudinal center of the movable plate, and an apex of the supporting protrusion is in contact with the base substrate to allow the movable plate to make pivot motion about the apex, and the movable plate further has, on the surface facing to the base substrate, stopper protrusions at both ends in a longitudinal direction, and an apex of each of the stopper protrusions comes in contact with the base substrate to regulate the pivot motion of the movable plate when the movable plate makes pivot motion. By providing the supporting protrusion, the movable plate can make the pivot motion easily. And, by providing the stopper protrusions, a stroke of the armature can be controlled precisely.

Preferably, the apex of the supporting protrusion and the apex of each of the stopper protrusions are in a same plane. In this case, the supporting protrusion and the stopper protrusions can be formed at the same time under the same conditions. The supporting protrusion, the stopper protrusions, and the movable contact base may be formed so that their apexes are in a same plane. In this case, it becomes easier to process them.

Preferably, a distance from the supporting protrusion to the movable contact base is longer than a distance from the supporting protrusion to a portion of the armature which is attracted to the electromagnetic device. In this case, it is possible to ensure a large stroke of the movable contact, so it is possible to ensure enough contact pressure of the movable contact.

Preferably, a distance from the supporting protrusion to the movable contact base is longer than a distance from the supporting protrusion to each of the stopper protrusions. In this case, it is possible to regulate the rotation of the armature by the stopper protrusion after the movable contact came in contact with the fixed contact.

Preferably, the pressure spring piece has a meandering part which meanders. By providing the meandering part, the length of the pressure spring piece is lengthened, so that the pressure which acts on the pressure spring piece is eased.

Preferably, the movable plate is made of a semiconductor substrate and has a hole extending from an upper surface to a undersurface, and the magnetic material is disposed on a surface of the movable plate so that it closes one end of the hole, and the armature block further has a second magnetic material or a metal piece, and the second magnetic material or the metal piece is disposed so that it closes an other end of the hole, and the magnetic material and the second magnetic material or the metal piece are jointed to each other inside the hole by laser welding, and the movable plate is sandwiched between the magnetic material and the second magnetic material or the metal piece. In this case, warpage and so on of the movable plate caused by difference of thermal expansion coefficient between the movable plate and the magnetic material can be suppressed.

BEST MODE FOR CARRYING OUT THE INVENTION

Hereinafter, the present invention will be described in more detail with reference to the accompanying drawings.

First Embodiment

Figure 1:
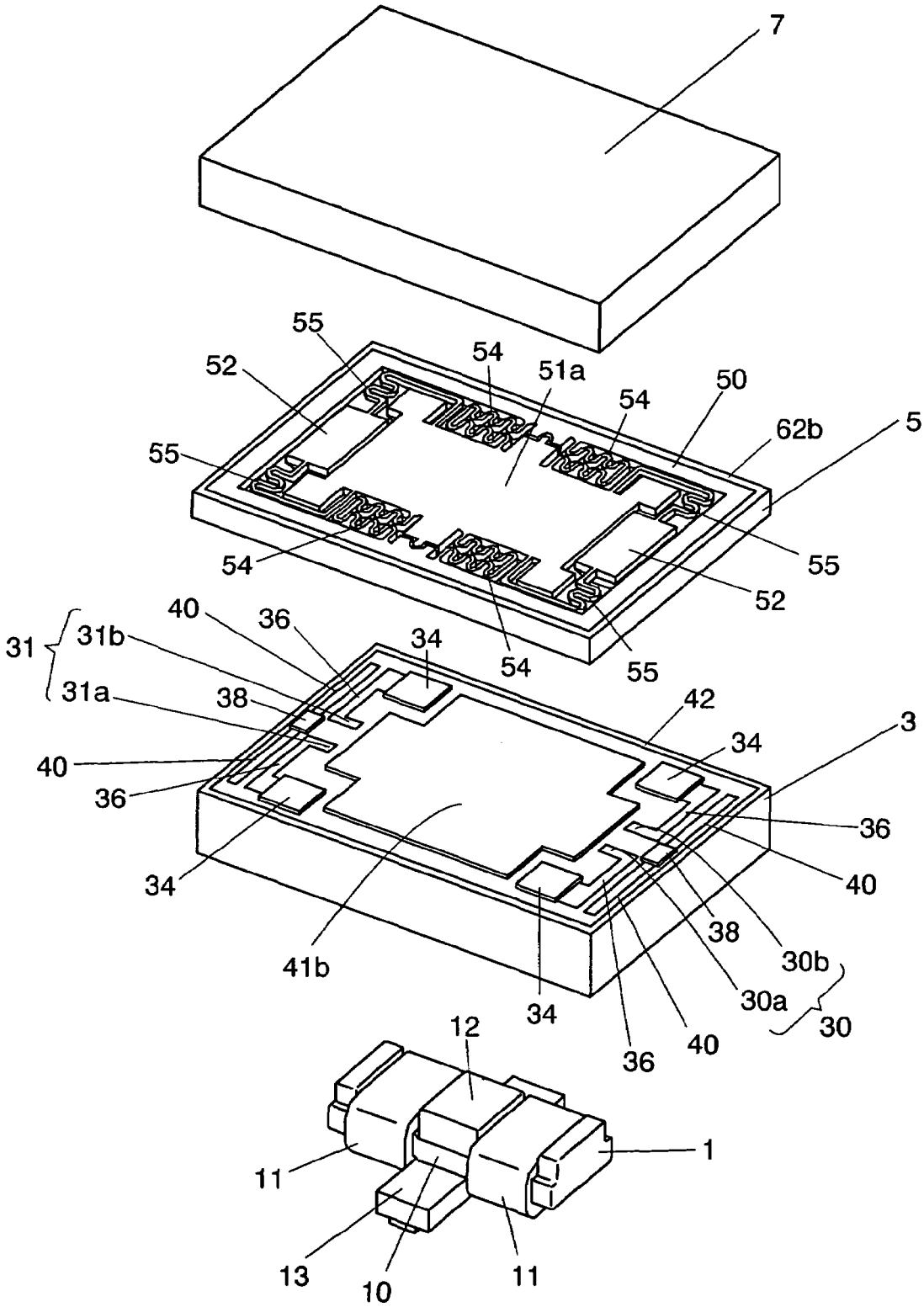
FIG. 1 is an exploded perspective view of a micro relay in accordance with a first embodiment of the present invention.
Figure 2:
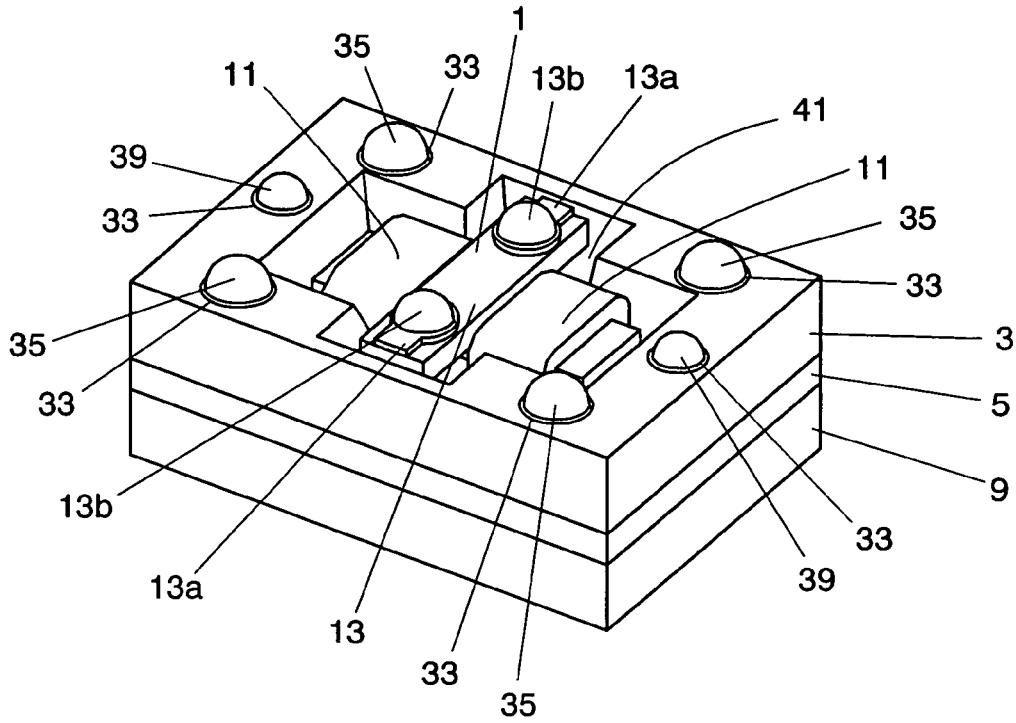
FIG. 2 is a perspective view of the micro relay looked from a bottom side.
Figure 3:
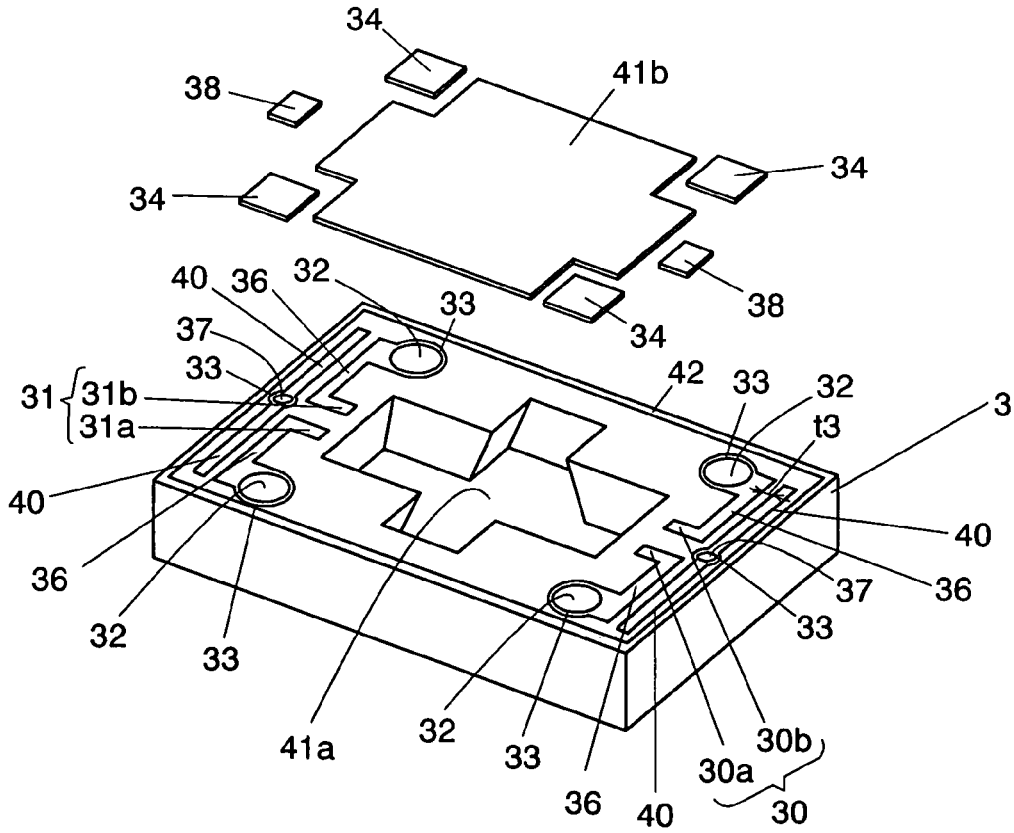
FIG. 3 is an exploded perspective view of a body of the micro relay.
Figure 4:
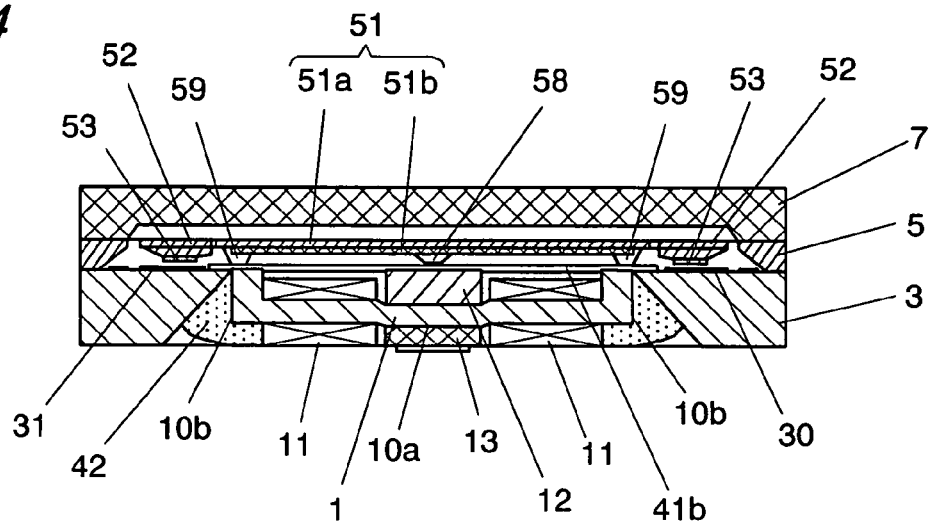
FIG. 4 is a sectional view of the micro relay.

FIG. 1 shows a micro relay in accordance with a first embodiment of the present invention. The micro relay comprises an electromagnetic device 1, a base substrate 3, an armature block 5, and a cover 7. As shown in FIG. 2, the base substrate 3 has, on the bottom side, a storage recess 41 for accommodating the electromagnetic device 1, and as shown in FIG. 3, the base substrate 3 has two pairs of fixed contacts 30, 31, on an upper surface thereof. The armature block 5 comprises a frame 50 secured to the upper surface of the base substrate, a movable plate 51*a* disposed inside the frame 50 and supported rotatably by the frame 50 through supporting spring pieces 54, and movable contact bases 52 having movable contacts 53 on an undersurface thereof and supported by the movable plate 51*a* through pressure spring pieces 55. As shown in FIG. 4, the movable plate 51*a* cooperates with a magnetic material 51*b* provided on an undersurface thereof to define an armature 51, and is driven by the electromagnetic device 1 to switch on/off a connection between the movable contacts 53 and the pairs of the fixed contacts 30, 31. The cover 7 is closely bonded to an upper surface of the frame 5. That is, the micro relay of this embodiment is a sealed micro relay in which the armature 51, the movable contacts 53, and the pairs of the fixed contacts 30, 31 are housed in a sealed space surrounded by the frame 51 and closed between the base substrate 3 and the cover 7.

Figure 5:
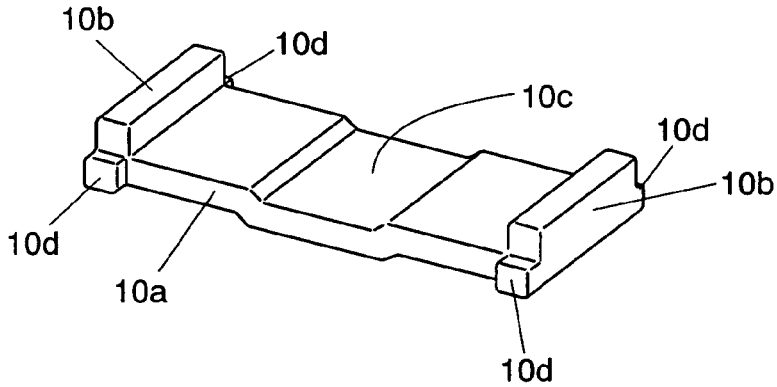
FIG. 5 is a perspective view of a yoke used in the micro relay.
Figure 6:
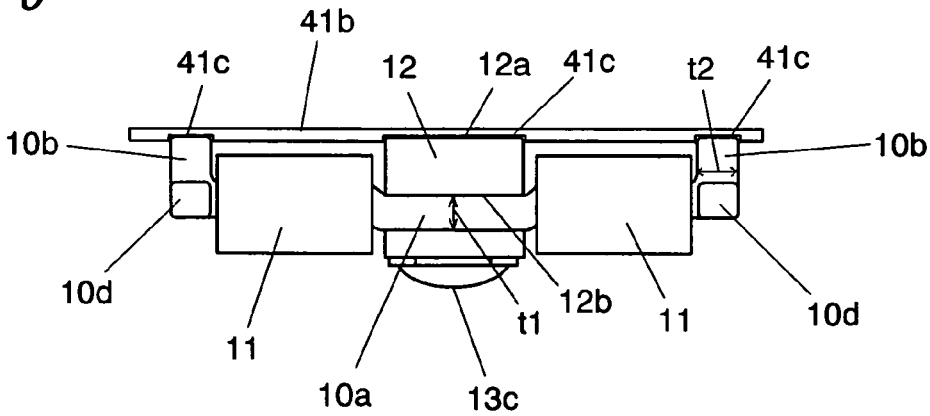
FIG. 6 is a front view of an electromagnetic device of the micro relay.

The electromagnetic device 1 comprises a yoke 10, a coil 11 which is wound around the yoke 10 and generates a flux in response to an exciting current, and a permanent magnet 12 which is bonded to the yoke 10 and generates a flux flowing through the armature 51 and the yoke 10. In more detail, as shown in FIG. 5, the yoke 10 has a generally U-shaped configuration, and it comprises a plate-shaped cross-member 10*a* around which the coil 11 is wound and a pair of leg pieces 10*b* upstanding from both ends of the cross-member 10*a*. The yoke 10 is made of an iron plate, such as a soft magnetic iron sheet, by means of, for example, bending process, forging process, or stamping process. The cross section of each of the leg pieces 10*b* is a rectangle. The cross-member 10*a* has a concave portion 10*c* for putting the permanent magnet 12 in, at the longitudinal center. The permanent magnet is a rectangular parallelepiped having a height, and its opposite faces in the height direction are magnetized to opposite poles, and as shown in FIG. 6, one pole face 12*b* is bonded to the concave portion 10*c*. By providing the concave portion 10*c*, the height of the electromagnetic device 1 can be lowered. Or, a large permanent magnet which has extra height equal to the depth of the recess 10*c* can be used to increase the suction power. The coil 11 is directly wound around the cross-member 10*a* on both sides of the permanent magnet 12 so that top end surfaces of the leg pieces 10*b* are energized to the opposite poles in response to the exciting currents to the coil 11. When the coil 11 is wound, the leg pieces 10*b* as well as the side faces of the permanent magnet 12 act as flanges of a coil bobbin. The cross-member 10*a* has convex portions 10*d* at both ends of each of the both longitudinal side faces of the cross-member 10*a* to prevent the coil 11 from dropping from the yoke 10. That is, the convex portions 10*d* can prevent the coil 11 from dropping from the yoke 10 and can prevent product failure when the micro relay is manufactured.

The yoke 10 and the permanent magnet 12 are coated with resin, such as a polyimide, a fluorine resin, a polyamide-imide resin, a poly-para-xylylene, and a mixture thereof, after the permanent magnet 12 is bonded to the yoke 10. The coating can isolate the yoke 10 and the permanent magnet 12. The coating can also protect the yoke 10 and the permanent magnet 12 from rust. Furthermore, the coating can prevent a winding of the coil from being broken by burrs of the yoke and the permanent magnet 12 when the coil is wound, because the coating covers the burrs on the surfaces of the yoke and the permanent magnet 12. In order to prevent the winding of the coil from being broken, the edges of the yoke and the four corners of the top end surface of the permanent magnet 12 may be rounded. For rounding the edges of the yoke 10, chemical etching can be used.

Furthermore, the top end surfaces of the leg pieces 10*b* and a pole face 12*a* of the permanent magnet 12 are polished at the same time, and these three surfaces, namely the top end surfaces of the leg pieces 10*b* and the pole face 12*a* of the permanent magnet, are in the same plane. As a result, it is prevented that the magnetic gap between the electromagnetic device 1 and the armature 51 increases, so that the magnetic gap is stabilized and the suction power is stabilized.

As shown in FIG. 6, a thickness (t2) of each of the leg pieces 10*b* is formed thicker than a thickness (t1) of the cross-member 10*a* so that a cross-section area of each of the leg pieces 10*b* becomes larger than that of the cross-member 10*a*. As a result, a predetermined cross-section area for the magnetic path can be ensured even if the edge of the leg piece is rounded when the yoke is processed, so a predetermined suction power can be ensured without saturation of the magnetic flux.

As shown in FIG. 2, a coil terminal block 13 is secured to the center of the undersurface of the cross-member 10*a* along a direction perpendicular to the longitudinal direction of the cross-member 10*a*. The coil terminal block 13 has conductive traces 13*a* at both ends of the undersurface and each end of the coil 11 is electrically connected to each of the conductive traces 13*a*. Further, a first bump (a coil electrode) 13*b* is bonded to each of the conductive traces 13*a* for an electrical connection between the electric circuit on the printed board for carrying the micro relay and the coils. Instead of the bump 13*b*, an electrode pad for bonding wire may be formed.

The base substrate 3 is made of heat resistance glass, such as Pyrex (R), and is formed into a rectangular shape. As shown in FIG. 3, the pair of the fixed contacts 30 is composed of fixed contacts 30*a* and 30*b* which are disposed in a spaced relation to each other, and the pair of the fixed contacts 30 is disposed on the upper surface of the base substrate 3 at longitudinal one end of the base substrate 3. The pair of the fixed contacts 31 is composed of fixed contacts 31*a* and 31*b* which are disposed in a spaced relation to each other, and is disposed on the upper surface of the base substrate 3 at the other longitudinal end of the base substrate. The base substrate 3 has, near its four corners, fixed contact through-holes 32 extending from the upper surface of the base substrate 3 to the undersurface thereof. On a periphery of each end of each of the through-holes 32, a land 33 is formed. Each of the fixed contacts is electrically connected to an adjacent land 33 on the upper surface of the base substrate 3 through a linear wiring trace 36 formed on the upper surface of the base substrate 3. The lands 33 at both ends of each of the through-holes 32 are electrically connected to each other through a fixed contact conductive layer formed on the inner surface of each of the through-holes 32 from a conductive material. The opening of each through-hole 32 is in the form of a circle, and the opening of each of the through-hole on the upper surface side of the base substrate 3 is closed by a first lid (a through-hole lid) 34 formed from a silicon thin film. A second bump 35 is secured to each of the lands 33 on the undersurface side of the base substrate 3, as a fixed contact electrode. After all, each of the fixed contacts is electrically connected to each of the second bump (the fixed contact electrode) 35 through the wiring trace 36 and the fixed contact conductive layer.

Furthermore, the base substrate 3 has, at both ends in the longitudinal direction, ground through-holes 37 extending from the upper surface of the base substrate 3 to the undersurface thereof. The land 33 is also formed on a periphery of each end of each of the ground through-holes 37, and the lands 33 of both ends of each of the ground through-holes 37 are electrically connected to each other by a ground conductive layer (not shown) formed on the inner surface of each of the ground through-holes 37. The opening of each ground through-hole 37 is in the form of a circle, and the opening of each of the ground through-holes 37 on the upper surface side of the base substrate 3 is closed by a second lid (a ground through-hole lid) 38 formed from a silicon thin film. A third bump 39 is fixed to each of the lands 33 on the undersurface side of the base substrate 3, as a ground electrode. Each of the ground through-holes 37 is located at the center of the base substrate 3 in a direction perpendicular to the longitudinal direction, and, on both sides of the ground through hole in the direction perpendicular to the longitudinal direction of the base substrate 3, ground traces 40 are formed on the upper surface of the base substrate 3. Each of the ground traces 40 is electrically connected to the land 33 of the ground through-hole 37 and each of the ground traces 40 is connected to the third bump (the ground electrode) 39 through the ground conductive layer. The ground trace 40 has a linear configuration, and runs parallel to the wiring trace 36 at fixed intervals (t3). The characteristic impedance of the wiring trace 36 can be set to a desired value by changing the intervals (t3) appropriately to improve the high frequency characteristic of the micro relay.

The fixed contacts and the wiring traces 36 and the ground traces 40 and the lands 33 can be made of a conductive material, for example, Cr, Ti, Pt, Co, Cu, Ni, Au, or an alloy thereof. The first bumps 13*b*, the second bumps 35, and the third bumps 39 can be made of a conductive material such as Au, Ag, Cu, and soldering. Each of the through-holes 32, 37 can be formed by sandblasting, etching, drilling, supersonic machining, and so on. The conductive layer of each of the through-holes is made of a conductive material such as Cu, Cr, Ti, Pt, Co, Ni, Au, or an alloy thereof, and is formed by means of plating, deposition, sputtering, and so on.

Figure 7:
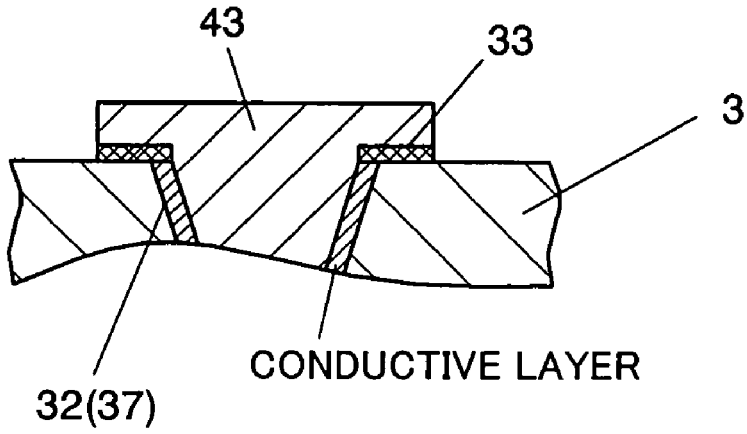
FIG. 7 is a partly enlarged illustration of another configuration of the micro relay.
Figure 8:
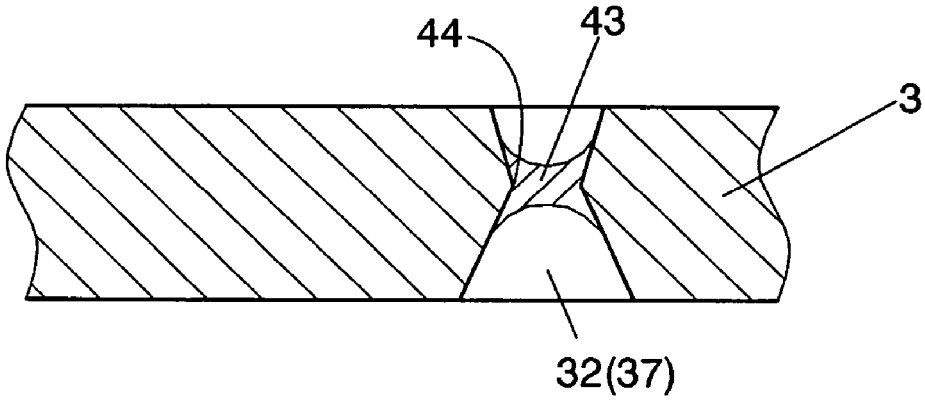
FIG. 8 is a partly enlarged illustration of another configuration of the micro relay.

Instead of closing the through-holes by using the first lids (the through-hole lids) 34 and the second lids (the ground through-hole closing means) 38, each of the through-holes may be closed by burying a metal material 43 in the through-hole, as shown in FIG. 7. The metal material 43 can be formed by plating. In this case, airtightness of the sealed space can be improved. If a material having high electric conductivity, such as Cu, Ag, and soldering, is used as a material of the plating, electric resistance between the fixed contact and the second bump (the fixed contact electrode) 35 or between the ground trace 40 and the third bump (the ground electrode) 39 can be reduced. As shown in FIG. 8, a constricted part 44 may be formed inside the through-hole, and the metal material 43 may be buried only near the constricted part 44. In this case, it becomes easy to plate the through-hole. Also, the amount of the metal material 43 can be reduced.

As mentioned above, the base has the storage recess 41 for accommodating the electromagnetic device 1 at the center on the bottom side of the base substrate 3. As shown in FIG. 3, the storage recess 41 is composed of a hole 41*a* extending from the upper surface of the base substrate 3 to the undersurface thereof, and a third lid (a storage recess lid) 41*b* made of a silicon thin film and fixed on the upper surface of the base substrate 3 to close the hole 41*a*. The opening of the hole 41*a* is in the form of a cross, and the hole 41 is formed in a tapered shape in which the opening area of the hole 41*a* becomes larger gradually toward the undersurface side of the base substrate 3 in order to reduce the opening area of the hole 41 on the upper surface side of the base substrate 3 and in order to make it easy to insert the electromagnetic device into the hole 41 from the undersurface side of the base substrate 3. The electromagnetic device 1 is housed in the storage recess 41 with the top end surfaces of the leg pieces 10*b* upward. As shown in FIG. 6, positioning hollows 41*c* are formed in the undersurface of the third lid (the storage recess lid) 41*b*, and the electromagnetic mechanism 1 is disposed in the storage recess 41 with the top end surfaces of the leg pieces 10*b* and the pole face 12*a* of the permanent magnet 12 fitted into the positioning hollows 41*c* in order to dispose the electromagnetic device 1 in the storage recess 41 with precision. When the electromagnetic device 1 was housed in the storage recess 41, the electromagnetic device 1 is isolated from the pairs of the fixed contacts 30 and 31 and the movable contacts 53 by the third lid (the storage recess lid) 41*b*. That is, the electromagnetic device 1 which includes organic material such as a coil is isolated from the contacts by the third lid (the storage recess lid) 41*b*. Therefore, the reliability of the contacts can be improved. Furthermore, because the storage recess 41 is composed of the hole 41*a* and the third lid (the storage recess lid) 41*b*, the height of the storage recess 41 can be maximized within a limited height of the base substrate 3. Therefore, a larger electromagnetic device can be used. Still furthermore, because the third lid (the storage recess lid) 41*b* is made of a silicon thin film, a magnetic gap between the electromagnetic device and the armature can be minimized.

After the electromagnetic device 1 is housed in the storage recess 41, interstices in the storage recess 41 are filled with potting compound, as shown in FIG. 4, to fix the electromagnetic device 1 to the base substrate 3. As the potting compound, silicon resin which has elastic deformability even after it hardened is preferable. The height of the electromagnetic device 1 is designed so that the undersurface of the coil terminal block 13 is in the same plane with the undersurface of the base substrate 3 when the electromagnetic device 1 was housed in the storage recess 41.

The first lid 34, the second lid 38, and the third lid 41*b* are formed by processing a silicone substrate thinly by means of polish, etching, etc., and the thickness of each lid is set to 20 μm. The thickness of each lid is not limited to 20 μm, but it can be set appropriately between about 5 μm and about 50 μm. Alternatively, the first lid 34, the second lid 38, and the third lid 41*b* may be made of a silicon layer which was formed by selectively removing a silicon substrate and an insulating layer from a SOI substrate which was composed of the silicon substrate and the thin film silicon layer formed on the insulation layer of the silicon substrate. In this case, each of the lids can be processed not only thinly but also precisely. Alternatively, a glass thin film formed by processing a glass substrate thinly by polish, etching, etc., may be used for the lids.

Figure 9A:
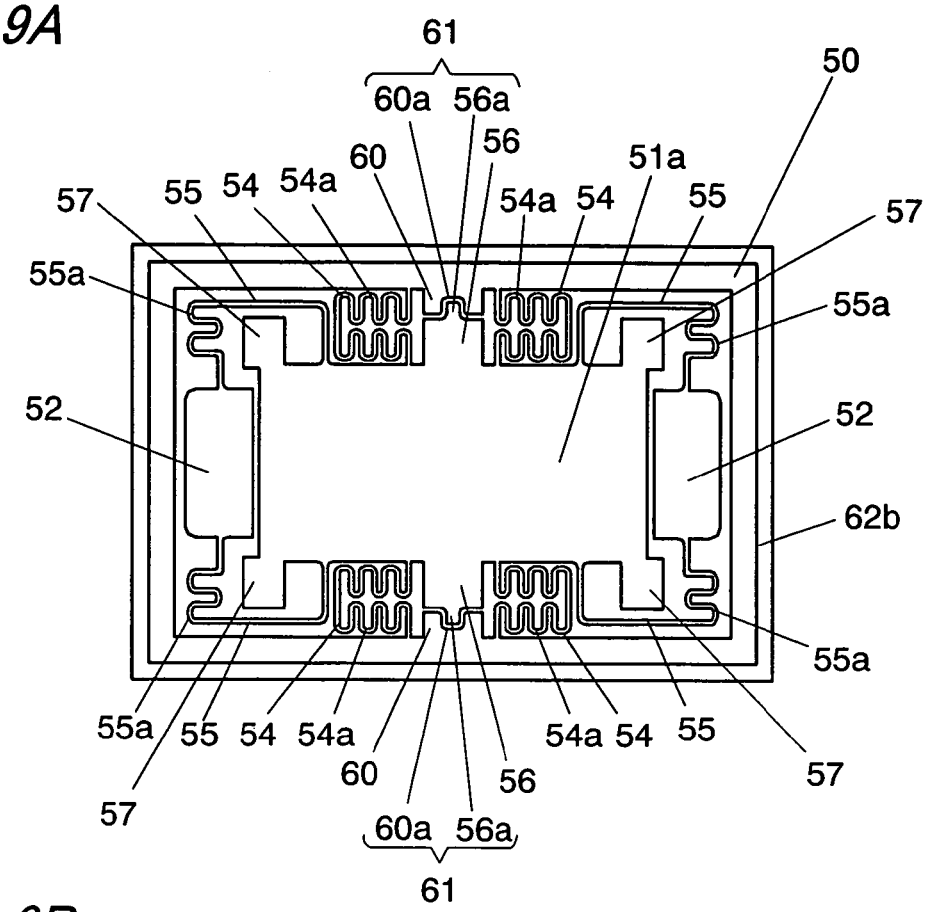
FIG. 9A is a plan view of an armature block of the micro relay.
Figure 9B:
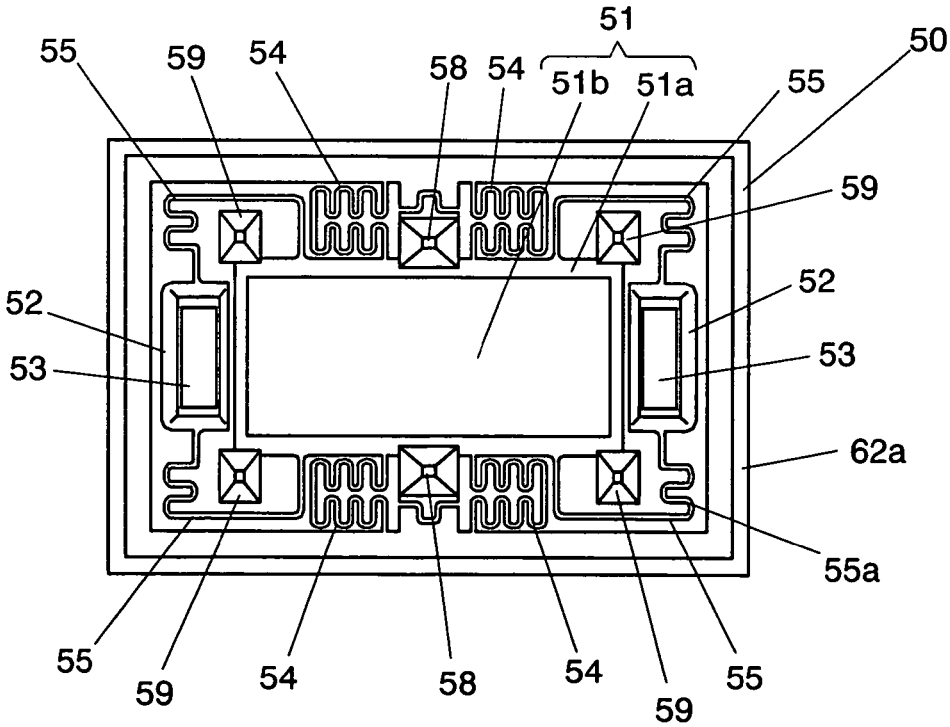
FIG. 9B is a bottom view of the armature block of the micro relay.
Figure 10:
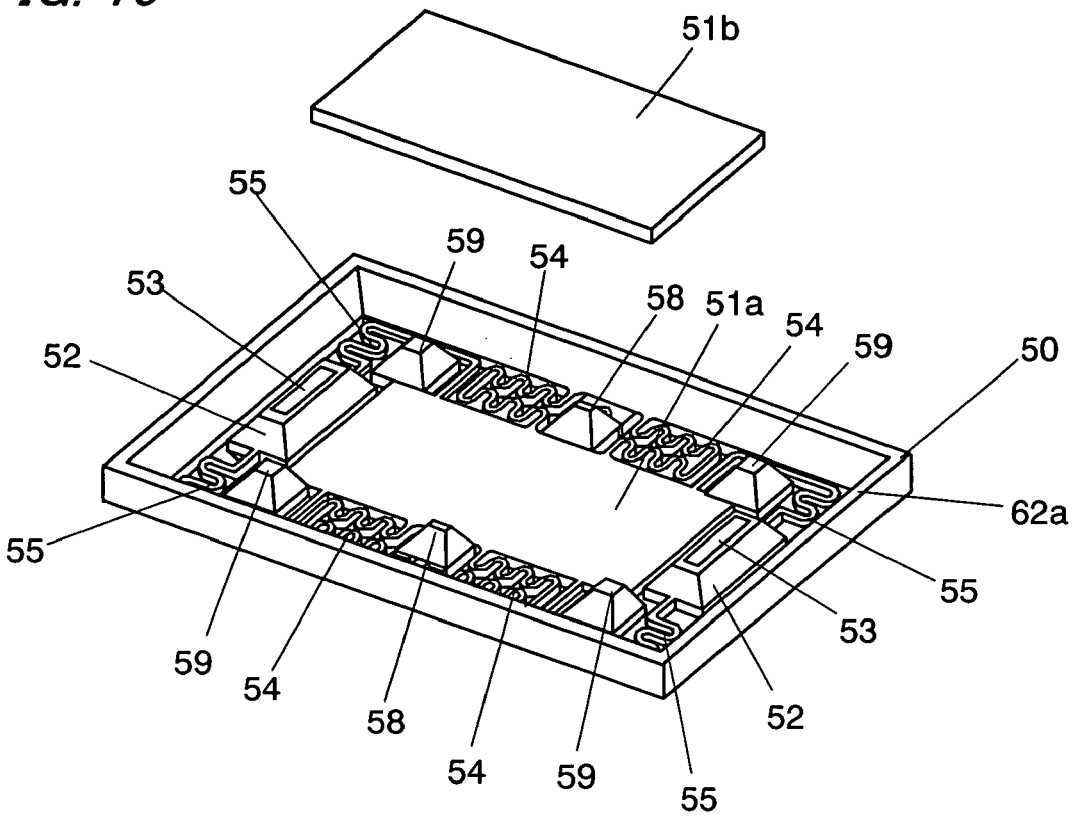
FIG. 10 is an exploded perspective view of the armature block of the micro relay.

The armature block 5 except for the magnetic material 51*b* (namely, the frame 50, the movable plate 51*a*, the movable contact bases 52, the supporting spring pieces 54, and the pressure spring pieces 55) is formed by processing one semiconductor substrate by means of semiconductor micromachining technology. As the semiconductor substrate, a silicon substrate having about 50 μm to about 300 μm, preferably 200 μm, in thickness is preferable. As shown in FIGS. 9A, 9B, and 10, the frame 50 of the armature block 5 is a rectangular frame having about the same circumference as the base substrate 3. The movable plate 51*a* is in the form of a flat plate, and it has first projecting pieces 56 at the center of each of the longitudinal sides of the movable plate 51*a* and second projecting pieces 57 at four corners thereof. Each of the first projecting pieces 56 has, on the base substrate 3 side, a supporting protrusion 58 which is in the form of a frustum of a quadrangular pyramid, and each of the second projecting pieces 57 has, on the base substrate 3 side, a stopper protrusion 59 which is in the form of a frustum of a quadrangular pyramid. The supporting protrusions 58 and the stopper protrusions 59 are processed so that the apexes of the supporting protrusions 58 and the apexes of the stopper protrusions 59 are in the same plane. After the armature block 5 is bonded to the base substrate 3, the apex of each of the supporting protrusions 58 is always in contact with the upper surface of the third lid (the storage recess lid) 41*b* and defines a fulcrum of the armature 51. The supporting protrusions 58 allow the armature to make pivot motion stably. The apex of each of the stopper protrusions 59 comes in contact with the upper surface of the base substrate 3 (not the upper surface of the third lid 41*b*) when the armature 51 makes the pivot motion, and it regulates the pivot motion of the armature 51. Therefore, a stroke of the armature 51 can be controlled precisely by controlling the dimensions of parts of the supporting protrusions 58 and the stopper protrusions 59 projecting from the movable plate 51. Because the armature block 5 is manufactured by means of the semiconductor micromachining technology, the control of the dimensions of the parts of the supporting protrusions 58 and the stopper protrusions 59 is easy even if the micro relay is small. In addition, because the apexes of the supporting protrusions 58 and the stopper protrusions 59 are in the same plane, the supporting protrusions 58 and the stopper protrusions 59 can be formed at the same time under the same conditions. So, it is easy to manufacture the micro relay. The shape of the stopper protrusion 58 and the shape of the stopper protrusion 59 are not limited to the frustum of a quadrangular pyramid, but it may be, for example, in the form of a quadrangular prism.

Each of the first projecting pieces 56 has a convex part 56*a* on the side face facing to the frame 50, and the frame 50 has, on the inner surface of the frame 50 facing to the convex parts 56*a*, third projecting pieces 60 each of which has a concave part 60*a*. Each of the convex parts 56*a* is engaged into the corresponding concave part 60*a* in the same plane as the frame 50, and the convex part 56*a* and the concave part 60*a* define a movement restriction part 61 which restricts a horizontal movement of the armature 51. Because there is a clearance between the convex part 56*a* and the concave part 56*a*, the movement restriction part 61 does not interfere with the pivot motion of the armature 51.

The magnetic material 51*b* is fixed on a surface of the movable plate 51*b* on the base substrate 3 side to define the armature 51 together with the movable plate 51*a*. The magnetic material 51*b* is made of, for example, soft magnetic iron, magnetic stainless, Permalloy, 42 alloy, etc. by means of machining process, etching, plating, and so on. The magnetic material 51 is designed to be thinner than the frame in thickness in order to create a predetermined gap between the magnetic material 51*b* and the third lid (the storage recess lid) 41*b* when the armature block 5 was bonded to the base substrate 3.

The movable plate 51*a* is rotatably supported by the frame 50 through supporting spring pieces 54 having elastic deformability. The supporting spring pieces 54 are formed at two sites on each longitudinal side of the movable plate 51 in a spaced relation to each other. One end of each of the supporting spring pieces 54 is connected to the frame 50 integrally, and the other end of it is connected to the movable plate 51*a* integrally. The supporting spring pieces 54 give the armature 51 return force when the armature 51 rotates. Each of the supporting spring pieces 54 has, between the one end thereof and the other end thereof, a meandering part 54*a* which meanders in one plane. By providing the meandering part 54, the supporting spring pieces 54 is lengthened, whereby the pressure which acts on the supporting spring pieces 54 when the movable plate 51*a* rotates can be distributed. Therefore, the meandering part 54*a* can prevent the supporting spring pieces 54 from being destroyed.

The movable contact base 52 is disposed between the armature 51 and the frame 50 at both longitudinal ends of the armature 51. The undersurface of each of the movable contact bases 52 projects below the undersurface of the armature 51. The movable contact 53 made of conductive material is fixed on the undersurface of each of the movable contact bases 52. Preferably, for easy manufacturing, the movable contact bases 52 are processed so that the apex of each of the movable contact bases 52 is in the same plane as the apex of each of the supporting protrusions 58 and the apex of each of the stopper protrusions 59. Each of the movable contact bases 52 is supported by the movable plate 51*a* through two pressure spring pieces 55 which have elastic deformability and give the contact pressure to the movable contact 53. Each of the pressure spring pieces 55 is formed so that it detours around the second projecting pieces 57, and one end of the each of the pressure spring pieces 55 is connected to the side of the movable contact base 52 integrally and the other end of it is connected to the side of the movable plate 51*a* integrally. Each of the pressure spring pieces 55 has a meandering part 55*a* in the middle part thereof. By providing the meandering part 55*a*, each of the pressure spring pieces 55 is lengthened, so that the pressure which acts on the pressure spring pieces 55 when the movable plate 51*a* rotates can be distributed. Therefore, the spring constant of the pressure spring piece 55 can be reduced without changing the cross-section area of the pressure spring piece 55 perpendicular to the running direction of the pressure spring piece 55. Or, the strength of the pressure spring pieces 55 can be improved without changing the spring constant by increasing the cross-section area of the pressure spring pieces 55. The distance between one movable contact 53 and the corresponding fixed contacts at the time when the movable contact 53 separates from the fixed contacts can be set to an intended distance by changing the thickness of the movable contact base 52 and/or the thickness of the movable contact 53.

In this embodiment, because each of the movable contact bases 52 is disposed between the longitudinal end of the armature 51 and the frame 50, a distance from one supporting protrusion 58 to one movable contact base 52 is longer than a distance from the supporting protrusion 58 to a portion of the magnetic material 51*b* which is attracted to the electromagnetic device 1 (that is, a portion of the magnetic material 51*b* facing to the leg piece 10*b* of the yoke 10). Therefore, the stroke of the movable contact base 52 is larger than that of the armature 51 when the armature 51 rotates in response to the suction power of the electromagnetic device 1. Therefore, it is possible to ensure a large stroke of the movable contact 53 even if the micro relay is small, so it is possible to ensure enough contact pressure of the movable contact.

Also, because each of the stopper protrusions 59 is located between the supporting protrusion 58 and the movable contact base 52, a distance from one supporting protrusion 58 to one movable contact base 52 is longer than a distance from the supporting protrusion 58 to one stopper protrusion 59. Therefore, when the armature 51 rotates, it is possible to regulate the rotation of the armature by the stopper protrusions 59 after the movable contact 53 came in contact with the fixed contact and obtained enough contact pressure.

Figure 11:
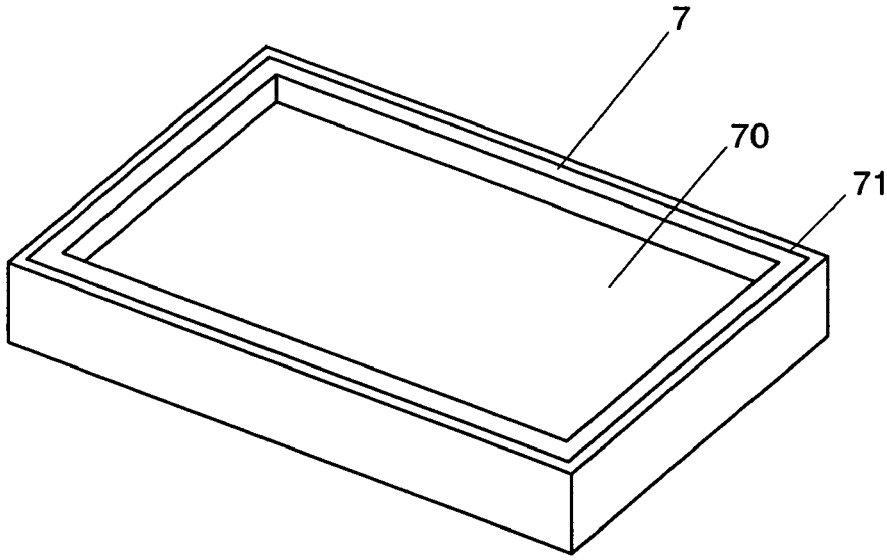
FIG. 11 is a perspective view of a cover of the micro relay looked from a bottom side.

The cover 7 is made of heat resistance glass, such as Pyrex (R), and, as shown in FIG. 11, it has, in a surface on the armature block side, a recess 70 for creating a space for the pivot motion of the armature 51. The cover 7 has about the same circumference as the frame 50 and the base substrate 3, and the cover 7, the frame 50, and the base substrate 3 forms one rectangular parallelepiped, when they were bonded to each other.

In order to bond the base substrate 3 and the frame 50 to each other, a metal thin film 42 for bonding is formed over entire circumference of a periphery of the upper surface of the base substrate 3, and a metal thin film 62*a* for bonding is formed over entire circumference of a periphery of the undersurface of the frame 50. Also, in order to bond the frame 50 and the cover 7 to each other, a metal thin film 62*a* for bonding is formed over entire circumference of a periphery of the upper surface of the frame 50, and a metal thin film 71 for bonding is formed over entire circumference of a periphery of the undersurface of the cover 7. The base substrate 3 and the armature block 5 are closely bonded to each other by pressure bonding between the metal thin film 42 and the metal thin film 62*a*, and the armature block 5 and the cover 7 are closely bonded to each other by pressure bonding between the metal thin film 62*b* and the metal thin film 71. Because the hole 41*a* of the storage recess 41, the fixed contact through-holes 32, and the ground through-holes 37 are closed by the lid 41*b*, the lid 34, and the lid 38, respectively, a sealed space surrounded by the frame 50 and closed between the base substrate 3 and the cover 7 is created, and the armature 51, the pairs of the fixed contacts 30, 31, and the movable contacts 53 are housed inside the sealed space. Therefore, it is prevented that external foreign body gets inside the micro relay and degrades the reliability of the contact. In order to prevent the surface of the fixed contacts and the movable contacts 53 from being oxidized and degraded, the sealed space may be evacuated, or inert gases may be encapsulated. These metal thin films 42, 62*a*, 62*b*, and 71 can be made of, for example, Au, Al—Si, Al—Cu, and so on.

When the micro relay constituted as above is mounted on a printed circuit board, first, the first bumps 13*b*, the second bumps 35, and the third bumps 39 are formed on the undersurface of the base substrate 3 by means of soldering balls, as shown in FIG. 2. Then, the first bumps (the coil electrodes) 13*b* are connected to driving conductive traces formed on the printed circuit board, and the second bumps (the fixed contact electrodes) 35 are connected to signal conductive traces formed on the printed circuit board, and the third bumps (the ground electrodes) 39 are connected to ground conductive traces formed on the printed circuit board. Or, the micro relay may fixed on the printed circuit board in a reversed state (that is, a state shown in FIG. 2), and these bumps 13*b*, 35, 39 may be bonded to the printed circuit board by means of wire bonding.

Hereinafter, the movement of the micro relay will be described. When the coil 11 was energized, a flux generated by the coil 11 flows in the same direction as a flux of the permanent magnet 12 at one leg piece 10*b* of the yoke 10 and it flows in the direction opposite to the flux of the permanent magnet 12 at the other leg piece 10*b*. Therefore, suction power is generated between the top end surface of the one leg piece 10*b* and the magnetic material 51*b*, so that one longitudinal end of the magnetic material 51*b* is attracted to the top end surface of the one leg piece 10*b*, and the armature 51 begins to rotate about the two supporting protrusions 58. And that time, the movable contact bases 52 begins to rotate together with the armature 51, and the movable contact 53 fixed on one movable contact base 52 comes in contact with the corresponding pair of the fixed contacts 30 (or 31) so as to electrically connect the fixed contact 30*a* (or 31*a*) and the fixed contact 30*b* (or 31*b*).

At a point in time when the movable contact 53 came in contact with the pair of the fixed contacts 30 (or 31), the apexes of the stopper protrusions 59 do not come in contact with the base substrate 3, and the armature 51 rotates further (in other words, the armature 51 over-travels.). The pressure spring pieces 55 are bent by this over-travel, and, contact pressure in accordance with an amount of the over-travel of the armature 51 (in other words, a travel amount of the armature 51 after the movable contact 53 came in contact with the pair of the fixed contacts 30 (or 31)) is generated between the movable contact 53 and the pair of the fixed contacts 30 (or 31). After that, the apexes of the stopper protrusions 59 come in contact with the base substrate 3 to regulate the rotation of the armature 51. Even if the energization of the coil 11 is stopped in this condition, the connection between the movable contact 53 and the pair of the fixed contacts 30 (or 31) is maintained by the flux generated by the permanent magnet 12.

When the coil 11 is energized in the opposite direction, the magnetic material 51*b* is attracted to the other leg piece 10*b* of the yoke 10, and the armature 51 begins to rotate, and the movable contact 53 fixed on the other movable contact base 52 comes in contact with the corresponding pair of the fixed contacts 31 (or 30). And, contact pressure is generated by the over-travel of the armature 51, and then the rotation of the armature 51 is regulated by the stopper protrusions 33*a*. Even if the energization of the coil 11 is stopped in this condition, the connection between the movable contact 53 and the pair of the fixed contacts 31 (or 30) is maintained by the flux generated by the permanent magnet 12.

As mentioned above, it is not necessary for the micro relay of this embodiment to provide a spacer between the armature and the base substrate because the permanent magnet 12 is secured to the yoke 10, therefore, the micro relay can reduce the thickness. The thickness of the entire micro relay is defined by a total of the thickness of the base substrate 3, the thickness of the frame 50, and the thickness of the cover 7. Furthermore, because the electromagnetic device 1 is housed in the storage recess 41 and is isolated from the contacts by the third lid (the storage recess lid) 41*b*, the micro relay has high reliability.

Although the base substrate 3 and the cover 7 are made of glass substrate respectively in this embodiment, one of the base substrate 3 and the cover 7, or both of the base substrate 3 and the cover 7, may be made of silicon substrate. If the base substrate 3 and the cover 7 are made of glass substrate respectively and the armature block 5 is made of silicon substrate, the base substrate 3 and the armature block 5, as well as the armature clock 5 and the cover 7, can be bonded directly by means of anodic bonding. In this case, the metal thin films for bonding 42, 62*a*, 62*b*, 71 can be eliminated.

Figure 12:
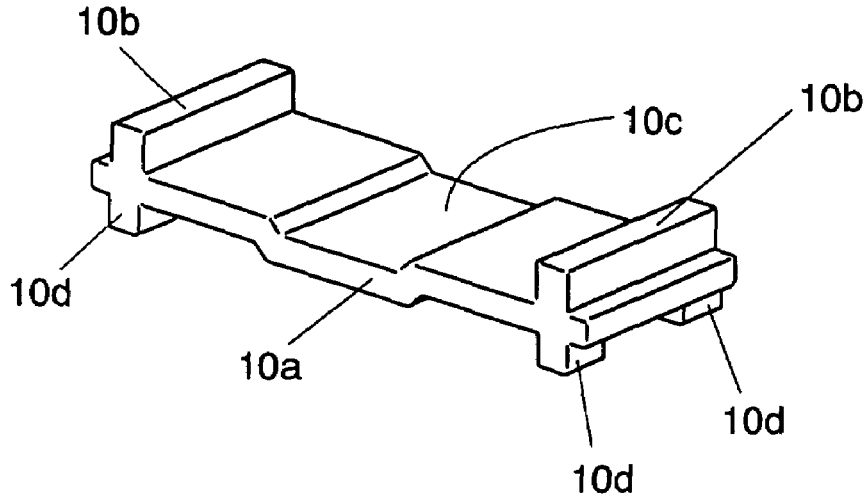
FIG. 12 is a view showing another configuration of the yoke of the micro relay.
Figure 13:
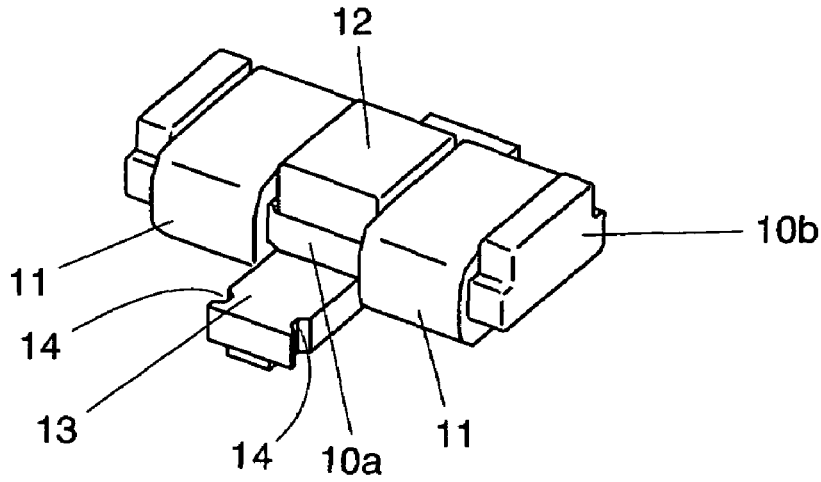
FIG. 13 is a view showing another configuration of the electromagnetic device of the micro relay.
Figure 14A:
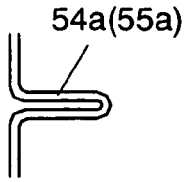
FIG. 14A is a view showing another configuration of a meandering part of the micro relay.
Figure 14B:
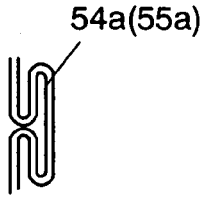
FIG. 14B is a view showing another configuration of the meandering part of the micro relay.
Figure 14C:
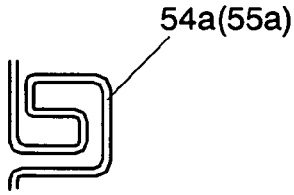
FIG. 14C is a view showing another configuration of the meandering part of the micro relay.
Figure 14D:
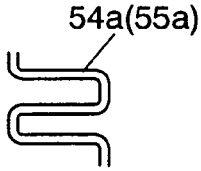
FIG. 14D is a view showing another configuration of the meandering part of the micro relay.
Figure 14E:
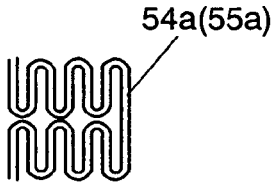
FIG. 14E is a view showing another configuration of the meandering part of the micro relay.
Figure 14F:
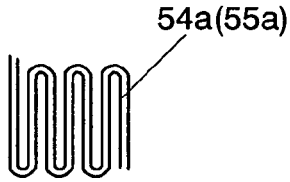
FIG. 14F is a view showing another configuration of the meandering part of the micro relay.

As to the electromagnetic device 1, although the convex portions 10*d* for preventing the drop of the coil 11 are formed at both ends of each of the longitudinal side faces of the cross-member 10*a* in this embodiment, the convex portions 10*d* may be formed at four corners on the undersurface of the cross-member 10*a*, as shown in FIG. 12. In this case, the convex portions 10*d* can not only work to prevent the coil 11 from dropping, but also work to decide the position of the electromagnetic device when the electromagnetic device is transported in a process of assembling the micro relay or when the electromagnetic device is transferred by a parts feeder. As shown in FIG. 13, notches 14 may be formed at both longitudinal ends of the coil terminal block 13 to wind the ends of the coil 11 easily around the coil terminal block 13.

Figure 15A:
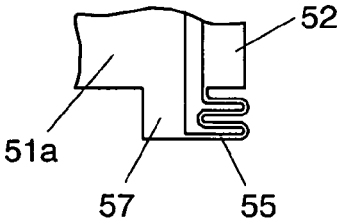
FIG. 15A is a view showing another configuration of a pressure spring piece of the micro relay.
Figure 15B:
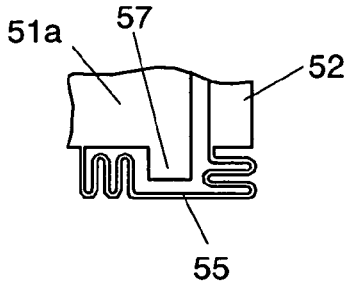
FIG. 15B is a view showing another configuration of the pressure spring piece of the micro relay.
Figure 16:
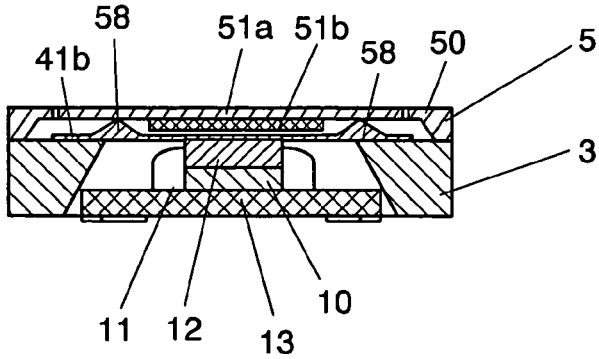
FIG. 16 is a view showing another configuration of a supporting protrusion of the micro relay.
Figure 17:
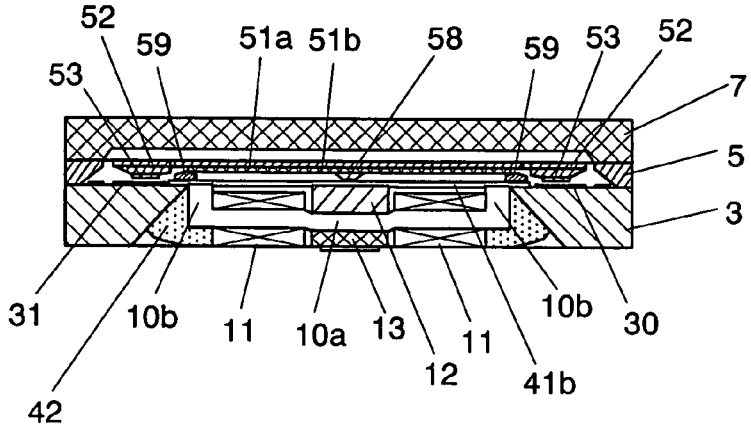
FIG. 17 is a view showing another configuration of a stopper protrusion of the micro relay.

As to the armature block 5, the meandering part 54*a* of the supporting spring piece 54 and the meandering part 55*a* of the pressure spring piece 55 may have a shape shown in FIGS. 14A to 14F. As shown in FIG. 15A, one end of the pressure spring piece 55 may be integrally connected to the second projecting piece 57. Or, as shown in FIG. 15B, the pressure spring piece 55 may be disposed beside the longitudinal side surface of the movable plate 51*a*. As shown in FIG. 16, the supporting protrusions 58 may be formed on the upper surface of the third lid (the storage recess lid) 41*b*, instead of being formed on the first projecting pieces 56. Also, as shown in FIG. 17, the stopper protrusions 59 may be formed on the upper surface of the third lid (the storage recess lid) 41*b*, instead of being formed on the second projecting pieces 57. Although, in this embodiment, the spring constant of the supporting spring piece 54 was decided so that the suction power by the permanent magnet 12 is larger than the return power of the supporting spring piece 54, the spring constant of the supporting spring piece 54 may be decided so that the suction power by the permanent magnet 12 is smaller than return power of the supporting spring piece 54.

Figure 18:
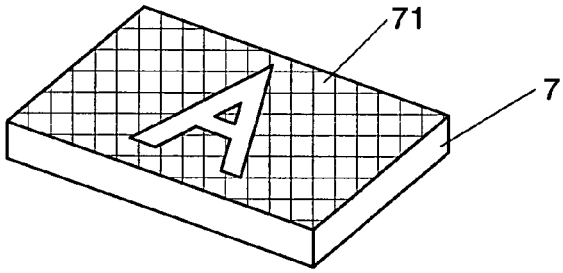
FIG. 18 is a view showing another configuration of a cover of the micro relay.

As to the cover 7, as shown in FIG. 18, it is preferable that a metal thin film 71 is secured to the upper surface of the cover, and the metal thin film 71 is marked with a lot number, a brand name, etc. by means of a laser marking device. In this case, even if the micro relay is small, visibility of the lot number, a brand name, etc. can be improved.

Hereinafter, manufacturing method of the micro relay of this embodiment will be described briefly. The manufacturing method includes an armature block forming process, a sealing process, and an electromagnetic device setting process. In the armature block forming process, a silicon substrate is processed by means of semiconductor micromachining technology, namely micro machining technology, such as lithography technology, and etching technology so as to form the frame 50, the movable plate 51*a*, the movable contact bases 52, the supporting spring pieces 54, and the pressure spring pieces 55. Then, the magnetic material 51*b* is secured to the surface of the movable plate 51*a* on the base substrate 3 side, and the movable contact 53 is bonded to the movable contact base 52. In the sealing process, the armature block 5, the base substrate 3, and the cover 7 are bonded to each other by means of pressure bonding or anodic bonding so as to create a sealed space surrounded by the base substrate 3, the cover 7, and the frame 50 of the armature block 5. In the electromagnetic device setting process, the electromagnetic device 1 is housed in the storage recess 41 of the base substrate 3, and then the electromagnetic device 1 is fixed to the base substrate 3.

To form the base substrate 3, first, the hole 41*a* of the storage recess 41 and the through-holes 32 and 37 are formed in a glass substrate which becomes a basis for the base substrate 3 by etching, or sandblasting, and then the lands 33, the pairs of the fixed contacts 30 and 31, the wiring traces 36, the ground traces 40, the conductive layers, and so on are formed by means of sputtering, plating, etching. Then, the hole 41*a* and the through-holes 32, 37 are closed by the third lids 41*b*, the first lid 34, and the second lids 38, respectively.

To form the cover 7, first, the recess 70 is formed in a glass substrate which becomes a basis for the cover 7 by means of etching, sandblasting, and so on, and then, the metal thin film 71 is formed.

A wafer in which many armature blocks 5 were formed, a wafer in which many base substrates 3 were formed, and a wafer in which many covers 7 were formed may be bonded by pressure bonding or anodic bonding, and then the wafers may be divided into individual micro relays by dicing process and so on.

Figure 19A:
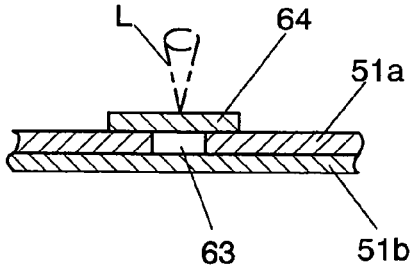
FIG. 19A is a partly enlarged illustration of another configuration of the micro relay.
Figure 19B:
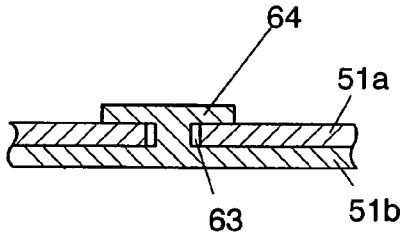
FIG. 19B is a partly enlarged illustration of another configuration of the micro relay.
Figure 20A:
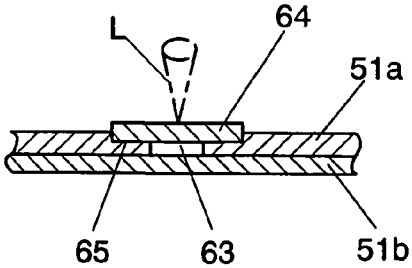
FIG. 20A is a partly enlarged illustration of another configuration of the micro relay.
Figure 20B:
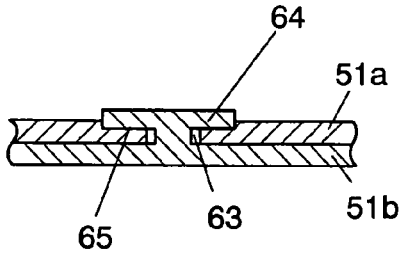
FIG. 20B is a partly enlarged illustration of another configuration of the micro relay.

As to the bonding method between the movable plate 51*a* and the magnetic material 51*b*, it is preferable that, as shown in FIG. 19A, the movable plate has a hole 63 extending from the upper surface of the movable plate to the undersurface thereof, and the magnetic material is disposed on the undersurface of the movable plate 51*a* so that it closes one end of the hole 63, and the armature block 5 has a second magnetic material (or a metal piece) 64 disposed on the upper surface of the movable plate 51*a* so that it closes the other end of the hole 63, and the magnetic material 51*b* and the second magnetic material 64 are jointed to each other inside the hole 63, as shown in FIG. 19B, by laser welding which irradiates the second magnetic material 64 with a laser L, and the movable plate 51*a* is sandwiched between the magnetic material 51*b* and the second magnetic material 64. In this case, because the movable plate 51*a* is jointed to the magnetic material 51*b* at only a portion near the hole 63, deformation of the movable plate, such as warpage and strain, which is caused by difference of thermal expansion coefficient between the movable plate 51*a* and the magnetic material 51*b* can be suppressed. As shown in FIGS. 20A and 20B, a recess 65 for putting the second magnetic material 64 in may be formed in the upper surface of the movable plate 51*a* to make the armature 51 thinner.

Second Embodiment

Figure 21:
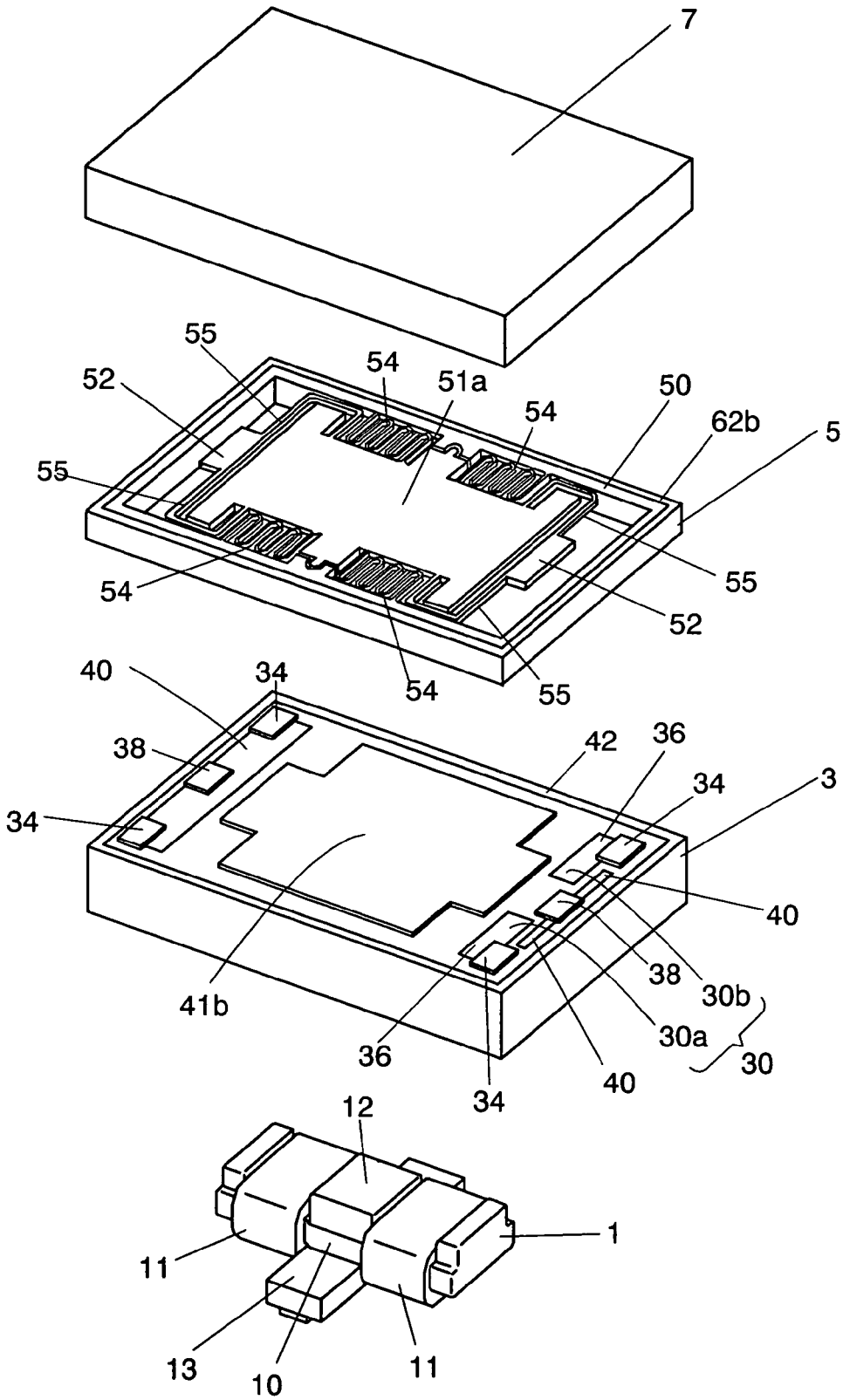
FIG. 21 is an exploded perspective view of a micro relay in accordance with a second embodiment of the present invention.

FIG. 21 shows a micro relay in accordance with a second embodiment of the present invention. The basic composition of this embodiment is identical to the first embodiment except the base substrate and the armature block, so the similar part of these embodiments are identified by the same reference character and no duplicate explanation is made here.

Figure 22:
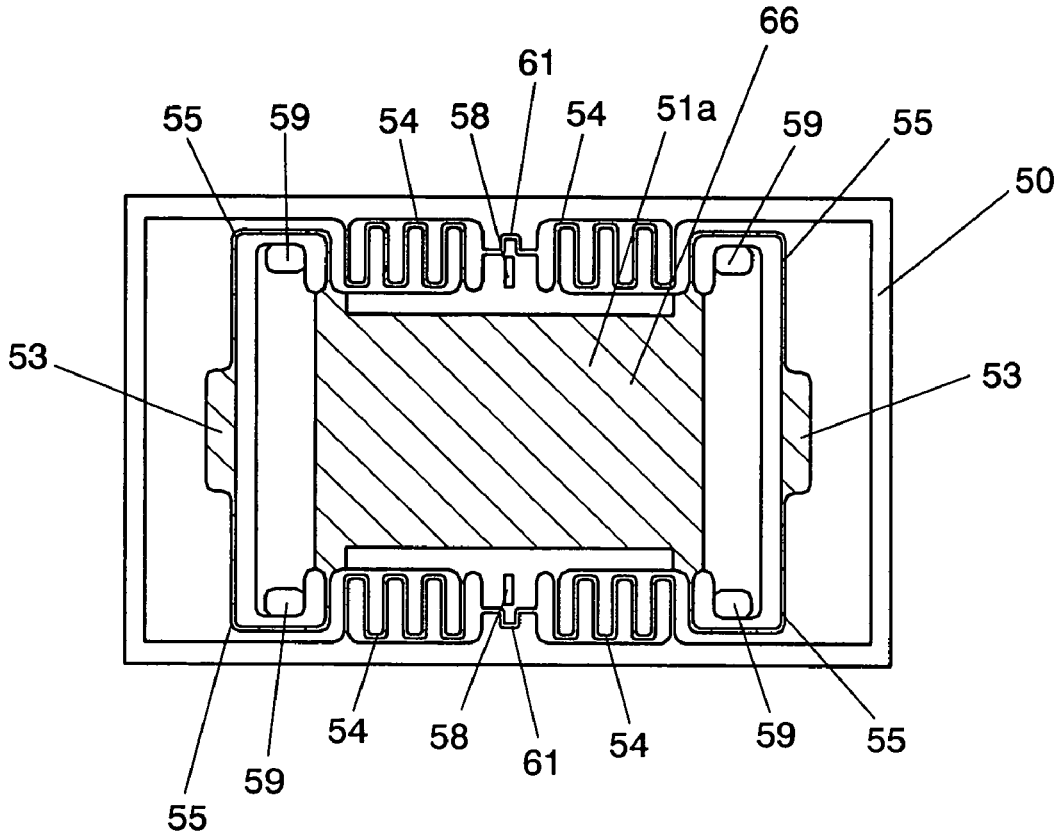
FIG. 22 is a view showing an armature block of the micro relay with a magnetic material removed, looked from a bottom side.

In this embodiment, the pair of the fixed contacts 31 of the first embodiment is integrated with the ground trace 40 and is grounded. And, as shown in FIG. 22, two movable contacts 53 are connected to each other through a conductive trace 66 formed on the undersurface of the movable plate 51*a*. That is, the micro relay of this embodiment is a SPST (Single-Pole Single-Throw) micro relay having one normally open or closed contact. In addition, a shape of the supporting spring piece 54 of the meandering part 54*a* is different from the shape of the first embodiment, and the pressure spring piece 55 does not have a meandering part.

In this embodiment, when the pair of the fixed contacts 30 is opened, one movable contact 53 comes in contact with the ground trace 40. At that time, because two movable contacts are electrically connected to each other by the conductive trace 66, the other movable contact 53 facing to the pair of the fixed contacts 30 is also electrically connected to the ground trace 40. Therefore, high frequency characteristic (isolation characteristic) of the micro relay can be improved.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. A micro relay comprising:

a base substrate having an electromagnetic device, said base substrate having a fixed contact on one surface thereof;

an armature block including a frame secured to the surface of said base substrate, a movable plate disposed inside said frame and supported rotatably by said frame, and a movable contact base supported by said movable plate and having a movable contact, said movable plate cooperating with a magnetic material provided on a surface of said movable plate to define an armature and being driven by said electromagnetic device to switch on/off a connection between said fixed contact and said movable contact;

a cover bonded to said frame, said cover creating a space surrounded by said frame and closed between said base substrate and the cover to accommodate said armature and said fixed contact;

wherein said base substrate has a storage recess for accommodating said electromagnetic device, said storage recess being composed of a hole extending from the one surface of said base substrate to a rear surface thereof and a thin storage recess lid fixed on the one surface of said base substrate to close said hole, said electromagnetic device including a yoke, a coil wound around said yoke to generate a flux in response to an exciting current, and a permanent magnet secured to said yoke to generate a flux flowing through said armature and said yoke.

2. The micro relay as set forth in claim 1, wherein said yoke comprises a plate-shaped cross-member and a pair of leg pieces upstanding from both ends of said cross-member, said permanent magnet having a height and its opposite faces in a height direction being magnetized to opposite poles, one pole face of said permanent magnet being secured to a longitudinal center of said cross-member between said pair of leg pieces, said coil being wound around said cross-member on both sides of said permanent magnet, top end surfaces of said leg pieces being energized to opposite poles in response to the exciting current to said coil.

3. The micro relay as set forth in claim 2, wherein said cross-member has a concave portion in which said permanent magnet is put.

4. The micro relay as set forth in claim 2, wherein said cross-member has convex portions for preventing said coil from dropping.

5. The micro relay as set forth in claim 4, wherein said convex portions are formed at four corners on an undersurface of said cross-member.

6. The micro relay as set forth in claim 2, wherein an exposed surface of said yoke and a surface of said permanent magnet are coated with resin.

7. The micro relay as set forth in claim 6, wherein the top end surfaces of said leg pieces and a top end surface of said permanent magnet are polished to remove resin coating, the top end surfaces of said leg pieces and the top end surface of said permanent magnet being in a same plane.

8. The micro relay as set forth in claim 2, wherein a cross-section area of each of said leg pieces is larger than that of said cross-member.

9. The micro relay as set forth in claim 1, wherein said storage recess lid is made of a silicon layer which was formed by selectively removing a silicon substrate and an insulating layer from a SOI substrate which comprises the silicon substrate and the thin film silicon layer formed on the insulation layer of the silicon substrate.

10. The micro relay as set forth in claim 1, wherein said cover is closely bonded to said frame to create a sealed space surrounded by said frame and closed between said base substrate and the cover, said base substrate having a fixed contact through-hole extending from the one surface of the base substrate to the rear surface thereof, a fixed contact electrode formed on the rear surface of the base substrate, a fixed contact conductive layer formed on an inner surface of said fixed contact through-hole for an electrical connection between said fixed contact and said fixed contact electrode, and a thin film through-hole lid provided on the one surface of said base substrate to close said fixed contact through-hole.

11. The micro relay as set forth in claim 1, wherein said cover is closely bonded to said frame to create a sealed space surrounded by said frame and closed between said base substrate and the cover, said base substrate having a fixed contact through-hole extending from the one surface of the base substrate to the rear surface thereof, a fixed contact electrode formed on the rear surface of the base substrate, a fixed contact conductive layer formed on an inner surface of said fixed contact through-hole for an electrical connection between said fixed contact and said fixed contact electrode, and a metal material buried in the through-hole to close the through-hole.

12. The micro relay as set forth in claim 1, wherein said base substrate has, on the one surface thereof, a wiring trace connected electrically to said fixed contact and a ground trace connected to ground, said wiring trace and said ground trace running in parallel in spaced relation to each other.

13. The micro relay as set forth in claim 12, wherein said cover is closely bonded to said frame to create a sealed space surrounded by said frame and closed between said base substrate and the cover, said base substrate having a ground through-hole extending from the one surface of the base substrate to the rear surface thereof, a ground electrode formed on the rear surface of the base substrate for earthing, a ground conductive layer formed on an inner surface of said ground through-hole for an electrical connection between said ground electrode and said ground trace, and a ground through-hole closing means for closing said ground through-hole.

14. The micro relay as set forth in claim 1, wherein said base substrate has two pairs of the fixed contacts at both ends in a longitudinal direction of the base substrate, one pair of the fixed contacts of the two pairs of the fixed contacts being grounded, said armature having two movable contacts corresponding to the two pairs of fixed contacts, said movable contacts being connected electrically to each other through a conductive path.

15. The micro relay as set forth in claim 1, wherein said movable plate is supported by said frame through a supporting spring piece having elastic deformability, said movable contact base being supported by said movable plate through a pressure spring piece, said frame, said movable plate, said movable contact base, said supporting spring piece, and said pressure spring piece being formed from one semiconductor substrate.

16. The micro relay as set forth in claim 15, wherein said movable plate has, on a surface facing to said base substrate, a supporting protrusion at a longitudinal center of the movable plate, an apex of said supporting protrusion being in contact with said base substrate to allow said movable plate to make pivot motion about said apex, said movable plate further having, on the surface facing to said base substrate, stopper protrusions at both ends in a longitudinal direction, an apex of each of said stopper protrusions coming in contact with said base substrate to regulate pivot motion of the movable plate when said movable plate makes the pivot motion.

17. The micro relay as set forth in claim 16, wherein the apex of said supporting protrusion and the apex of each of said stopper protrusions are in a same plane.

18. The micro relay as set forth in claim 16, wherein the apex of said supporting protrusion, the apex of each of said stopper protrusions, and an apex of said movable contact base are in a same plane.

19. The micro relay as set forth in claim 16, wherein a distance from said supporting protrusion to said movable contact base is longer than a distance from said supporting protrusion to a portion of said armature which is attracted to said electromagnetic device.

20. The micro relay as set forth in claim 16, wherein a distance from said supporting protrusion to said movable contact base is longer than a distance from said supporting protrusion to each of said stopper protrusions.

21. The micro relay as set forth in claim 15, wherein said pressure spring piece has a meandering part which meanders.

22. The micro relay as set forth in claim 1, wherein said movable plate is made of a semiconductor substrate and has a hole extending from an upper surface to a undersurface, said magnetic material being disposed on one surface of said movable plate so that it closes one end of said hole, said armature block further having a second magnetic material or a metal piece, said second magnetic material or said metal piece being disposed on the other surface of said movable plate so that it closes an other end of said hole, said magnetic material and said second magnetic material or said metal piece being jointed to each other inside said hole by laser welding, said movable plate being sandwiched between said magnetic material and said second magnetic material or said metal piece.

* * * * *